United States Patent [19]

Reilly

[11] 4,204,296

[45] May 27, 1980

[54] FLUID DYNAMIC FURNACE CLEANING SYSTEM

[76] Inventor: Richard J. Reilly, 1759 Venus Ave., St. Paul, Minn. 55122

[21] Appl. No.: 909,382

[22] Filed: May 25, 1978

[51] Int. Cl.[2] ..... F23J 3/02
[52] U.S. Cl. ..... 15/316 R
[58] Field of Search ..... 15/316 R, 317, 318; 165/95

[56] References Cited

U.S. PATENT DOCUMENTS

| | | | |
|---|---|---|---|
| 1,645,307 | 10/1927 | Snow | 15/318 |
| 1,995,133 | 3/1935 | Snow et al. | 15/317 |
| 2,066,014 | 12/1936 | Pfleider | 15/317 |

*Primary Examiner*—Christopher K. Moore
*Attorney, Agent, or Firm*—Neil B. Schulte

[57] ABSTRACT

A cleaning system for furnaces in which a cleaning fluid such as air is directed through nozzles in the furnace, exiting adjacent curved fluid attachment surfaces. The fluid follows the attachment surfaces and is thereby directed onto and across the dirty surfaces of the furnace to continuously scrub the soot therefrom.

8 Claims, 2 Drawing Figures

FLUID DYNAMIC FURNACE CLEANING SYSTEM

BACKGROUND OF THE INVENTION

Probably the most serious and intractable problems associated with the maintenance and operation of furnaces is the continuing necessity to maintain the interior furnace walls free of soot and other accumulated sediments which quickly build up and block the transfer of heat. This is particularly true with respect to coal fired boilers which have taken on a new importance in the face of dwindling supplies of oil and natural gas type fuels. Extremely heavy deposits of soot, ash, or slag can acccumulate on the interior walls of these furnaces producing very inefficient operation. The deposits can become so large and cumbersome that there is even a danger that they may fall off and physically damage the boiler.

In the prior art the solution to this problem has been to introduce through the furnace wall a large number of mechanically rotatable wall blowers sometimes called long-lance retracting blowers which rotate or oscillate. A high pressure cleaning fluid such as steam or air is directed through the lance onto the interior walls of the furnace in the hopes of blowing away the accumulated soot and ash. Mechanically rotated blowers have comparatively delicate mechanisms associated with them including driving gears and the various seals that convey the cleaning fluid through the rotating joints. Accordingly, the lance cannot be left in the furnace for long, but must be retracted, since it cannot endure the high operating temperatures therein. Normally, the lances are introduced periodically for a few minutes every hour or two and then withdrawn to protect their operating mechanisms. Hundreds of these lances may be required over the large surfaces of huge power plant boilers which are operated on a more or less continuous basis. Thus, this method of cleaning is extremely expensive, prone to frequent malfunction and failure, and cumbersome to operate. Furthermore, the resultant cleaning is not satisfactory since it can take place for only a small fraction of the time.

SUMMARY OF THE INVENTION

In brief, my invention avoids the mechanical apparatus associated with rotating long lance blowers and uses a fluid dynamic approach wherein jets of cleaning fluid are introduced into the furnace in positions adjacent to suitable curved fluid attachment surfaces. When a fluid stream is directed tangentially to a convex curved surface it follows that surface or remains attached thereto. This results from the phenomenon of fluid dynamics known as jet attachment. By designing the attachment surfaces with the proper geometry, it is possible to blanket the dirty surfaces of the furnace with the cleaning fluid to provide a continuous scrubbing action. This keeps the surfaces cleaner than the intermittent mechanical lance blower known in the prior art. Accordingly, the transfer of energy is more efficient and the furnace as a whole operates more efficiently. The danger of large accumulations of soot is eliminated and the system is, of course, less expensive and nearly maintenance free. Thus, it may be seen that it is an object of my invention to provide an improved furnace cleaning system. It is a further object of my invention to provide a furnace cleaning system utilizing fluid dynamic principles rather than mechanically movable parts. Further objects and advantages will become apparent on consideration of the following detailed description and drawings.

DESCRIPTION OF THE PREFERRED EMBODIMENT

Figure 1:
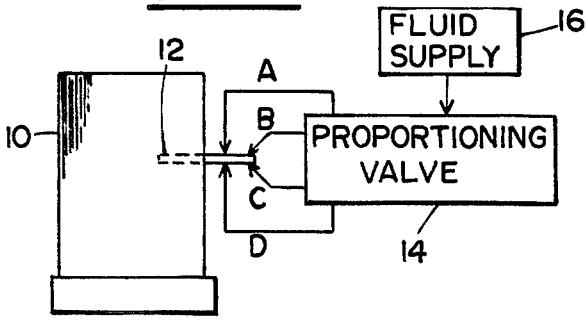
FIG. 1 is a schematic drawing of a furnace showing the blower tube therein.

A furnace 10 is schematically shown in FIG. 1 with the cleaning blower 12 of the present invention inserted through the wall thereof. In an actual furnace a large plurality of blowers would be utilized to cover the entire interior surface of the furnace. In FIG. 1 only one blower 12 is shown with connections A, B, C, and D between blower 12 and a proportioning valve 14. The cleaning fluid which may be heated air or steam or any other suitable fluid is supplied from a fluid supply 16 through valve 14 and into blower 12. Valve 14 may comprise, for example, a fluid amplifier or a mechanical valve well known to those skilled in the art.

Figure 2:
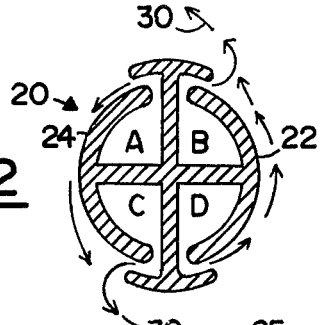
FIG. 2 is an enlarged cross sectional view of the blower showing the internal construction thereof with the cleaning fluid admission nozzles.
Figure 3:
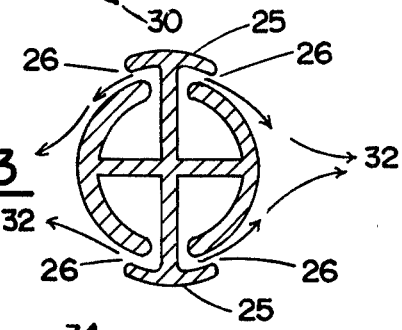
FIGS. 3 and 4 are views similar to FIG. 2 but showing alternative flow paths of the cleaning fluid.
Figure 4:
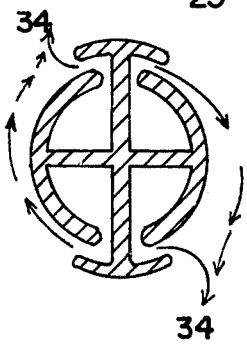

The blower 12 is shown in greater detail in FIGS. 2, 3, and 4 which comprise identical cross sectional views of the extrusion 20 which comprises the portion of the blower 12 inside furnace 10. Cleaning fluid connection lines A, B, C, and D connect respectively with the chambers A, B, C, and D shown in FIGS. 2, 3, and 4. In the preferred embodiment, extrusion 20 comprises generally a cross shaped member in which two of the arms of the cross support curved fluid attachment surfaces 22 and 24. The other two opposing arms of the cross support additional curved T-shaped members 25 so positioned as to create four nozzles or slots 26. If valve 14 is supplying a greater pressure to chambers A and D the higher flow of cleaning fluid therefrom will sweep about attachment surfaces 22 and 24 in the directions shown by arrows 30 in FIG. 2. As the pressure in chambers A and D is reduced, the pressure in chambers C and B may be increased causing the resultant flow of cleaning fluid to change until the flow reaches the directions shown by arrows 32 in FIG. 3 when the pressures are substantially equal. As valve 14 continues to change the pressure flow to the chambers so as to make the pressures in chambers B and C larger, the flow will assume the shape shown by arrows 34 in FIG. 4. The resulting effect is to sweep the cleaning fluid back and forth through a full 360 degree arc periodically as the pressures in the plenum chambers vary. In this way the interior surfaces of the furnace can be swept with cleaning fluid without moving the blower 12 at all. Since there are no moving parts whatsoever in this system, blower 12 can remain permanently inside the furnace and operate on a continuous basis. It would, of course, be possible to simplify the structure of the blower so as to utilize only half of the chambers, as for example chambers A and C. The fluid jet attachment phenomonen is such that the cleaning fluid will still sweep through an arc exceeding 270 degrees and the proper positioning of adjacent blowers 12 inside the furnace could provide adequate cleaning with this simpler embodiment.

Figure 5:
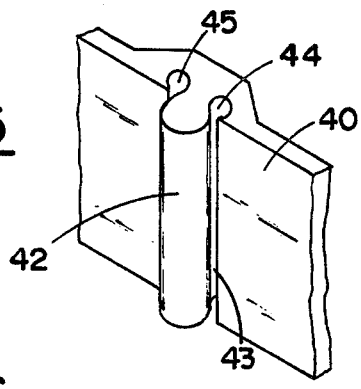
FIGS. 5 and 6 show another embodiment of my invention where the fluid is injected through the surface of the furnace wall itself.

Another variation on the invention is shown in FIG. 5 wherein a curved fluid attachment surface 42 is formed directly on the wall 40 of the furnace. A pair of parallel plenum chambers 44 and 45 supply cleaning fluid to narrow slots 43 on each side of attachment surface 42. With this arrangement pressurized fluid from plenum chambers 44 and 45 can be swept back and forth against the adjacent furnace walls by a simple oscillation of the relative pressures in plenum chambers 44 and 45 in the same manner as described with respect to FIGS. 2 through 4.

Figure 6:
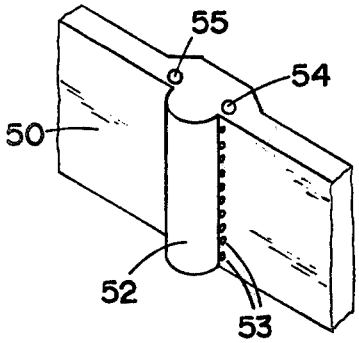

Still another variation can be seen in FIG. 6 wherein a curved attachment surface 52 on the furnace wall 50 is used to guide jets of air from small drilled nozzles 53 which communicate with plenum chambers 54 and 55. Again the principles of operation would be similar except that the overall flow of cleaning fluid in the furnace could be reduced by the smaller nozzle size.

Figure 7:
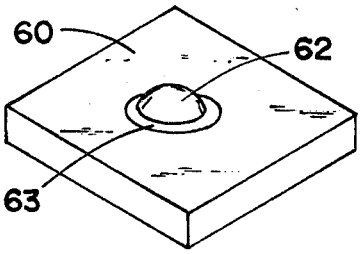
FIG. 7 shows another wall injection embodiment which employs a hemispherical fluid attachment surface.

In FIG. 7 still another embodiment of the invention is described wherein a hemispherical attachment surface 62 is formed on the furnace wall 60. An annular or circumferential slot 63 about the hemisphere allows fluid to enter on all sides of the hemisphere to be directed around the hemisphere and across the opposite furnace wall surface. Cleaning fluid could be admitted through various portions of the annular slot 63 by the use of segregated plenum chambers behind the furnace wall or by means of a mechanically rotated nozzle which because of its position outside the furnace would be protected from the hot exhaust gases inside the furnace and thus it could operate continuously with fewer repair problems than that experienced in the prior art long-lance retracting blowers. The various embodiments shown in FIGS. 2 through 7 demonstrate the many different ways the interior of this furnace could be cleaned by directing a fluid stream through a nozzle and across an adjacent fluid attachment surface so as to guide the fluid stream onto the various dirty surfaces. Mechanically movable nozzles outside the furnace, variable pressure systems, segregated plenum chambers, and various nozzle designs may all be used to control the flow characteristics of the cleaning fluid. Clearly, other permutations of these structural variations could be used which would be different from those given as examples in the drawings and therefore I do not intend to be bound to the specific embodiments shown herein except as defined by the appended claims.

I claim:

1. A fluid dynamic cleaning system for cleaning the inside surface of a furnace comprising in combination:

a cleaning fluid manifold means;

supply means to supply a pressurized cleaning fluid to said manifold means;

a plurality of entrance channels in said furnace, said channels connected to said manifold means so as to receive fluid therefrom; and fluid attachment surfaces adjacent the exit ends of said channels on the inside of the furnace operable to direct the flow of fluid.

2. The system of claim 1 including means to vary the pressure of the fluid from said supply means to selected entrance channels so as to vary the direction of flow on said fluid attachment surfaces.

3. The system of claim 2 in which said entrance channels are positioned in the walls of the furnace and said attachment surfaces are positioned on the furnace walls in positions adjacent the exit ends of the channels.

4. The system of claim 3 in which said entrance channels comprise slots and said attachment surfaces comprise part of a generally cylindrical surface.

5. The system of claim 3 in which said attachment surfaces comprise generally hemispherical surfaces surrounded by arcuate entrance channels.

6. The system of claim 1 in which said plurality of entrance channels are formed in the sides of a cylindrical tube, said tube mounted through the furnace wall to position the exit ends of the entrance channels proximate the inside surfaces of the furnace walls.

7. The system of claim 6 in which said cylindrical tube has segregated plenum chambers inside connected to the entrance channels and to said manifold means.

8. The system of claim 2 including means to vary the pressure of the fluid from said supply means to selected entrance channels so as to vary the direction of flow on said fluid attachment surfaces.

* * * * *

UNITED STATES PATENT AND TRADEMARK OFFICE

CERTIFICATE OF CORRECTION

PATENT NO. : 4,204,296

DATED : May 27, 1980

INVENTOR(S) : Richard J. Reilly

It is certified that error appears in the above-identified patent and that said Letters Patent are hereby corrected as shown below:

In claim 8, first line, the reference numeral "2" should read -- 7--.

Signed and Sealed this

*Fifth* Day of *August 1980*

[SEAL]

*Attest:*

SIDNEY A. DIAMOND

*Attesting Officer*

*Commissioner of Patents and Trademarks*